US008747063B2

(12) United States Patent
Tingler

(10) Patent No.: US 8,747,063 B2
(45) Date of Patent: Jun. 10, 2014

(54) INTEGRATED OPEN IMPELLER AND DIFFUSER FOR USE WITH AN ELECTRICAL SUBMERSIBLE PUMP

(75) Inventor: Kevin Scott Tingler, Bartlesville, OK (US)

(73) Assignee: Baker Hughes Incorporated, Houston, TX (US)

( * ) Notice: Subject to any disclaimer, the term of this patent is extended or adjusted under 35 U.S.C. 154(b) by 925 days.

(21) Appl. No.: 12/877,769

(22) Filed: Sep. 8, 2010

(65) Prior Publication Data

US 2012/0057970 A1 Mar. 8, 2012

(51) Int. Cl.
*F04D 29/44* (2006.01)

(52) U.S. Cl.
USPC ..... 415/199.2; 416/198 R

(58) Field of Classification Search
USPC ..... 415/187, 199.2, 901, 198 R
See application file for complete search history.

(56) References Cited

U.S. PATENT DOCUMENTS 2,775,945 A * 1/1957 Arutunoff ..... 415/172.1
8,070,426 B2 * 12/2011 Brunner et al. ..... 415/174.3

* cited by examiner

*Primary Examiner* — Dwayne J White
(74) *Attorney, Agent, or Firm* — Bracewell & Giuliani LLP

(57) ABSTRACT

An electrical submersible pump having a pump section with a stack diffusers and a stack of impellers mounted on a rotatable shaft. Flow paths extends through the pump section directed axially and radially within the impellers and diffusers. Vanes define the flow path through each impeller that provide fluid communication with an upstream side of each impeller and an outer circumference. An annular flow diverting hub is provided on a downstream side of each impeller. The hub has an outer surface that curves radially inward, and having a minimum radius proximate its middle portion. The diffusers are annular members coaxially mounted in a housing of the pump section. Passages define the flow path through each diffuser that extend axially along the pump section and radially between an outer and inner circumference of each diffuser. The outer surface of each hub makes up a portion of an associated passage.

20 Claims, 4 Drawing Sheets

INTEGRATED OPEN IMPELLER AND DIFFUSER FOR USE WITH AN ELECTRICAL SUBMERSIBLE PUMP

FIELD OF THE INVENTION

This invention relates in general to impellers and diffusers for use in electrical submersible pump (ESP) applications, and in particular to an ESP having an impeller with a bearing hub and a diffuser coupled with the impeller.

BACKGROUND OF THE INVENTION

In oil wells and other similar applications in which the production of fluids is desired, a variety of fluid lifting systems have been used to pump the fluids to surface holding and processing facilities. It is common to employ various types of downhole pumping systems to pump the subterranean formation fluids to surface collection equipment for transport to processing locations. One such conventional pumping system is a submersible pumping assembly which is immersed in the fluids in the wellbore. The submersible pumping assembly includes a pump and a motor to drive the pump to pressurize and pass the fluid through production tubing to a surface location. A typical electric submersible pump assembly ("ESP") includes a submersible pump, an electric motor and a seal section interdisposed between the pump and the motor.

Centrifugal well pumps are commonly used as the submersible pump in an ESP application to pump oil and water from oil wells. Centrifugal pumps typically have a large number of stages, each stage having a stationary diffuser and a rotating impeller driven by a shaft. The rotating impellers exert a downward thrust as the fluid moves upward. Also, particularly at startup and when the fluid flow is non-uniform, the impellers may exert upward thrust. It is most common for the impellers to float freely on the shaft so that each impeller transfers downward thrust to an adjacently located diffuser. Thrust washers or bearings are often located between each impeller and the upstream diffuser to accommodate the axially directed upward and/or downward thrusts.

SUMMARY

Disclosed herein is an electrical submersible pump (ESP), in one example embodiment the ESP is made up of an annular diffuser having passages that extend axially and radially throughout. Also included is an impeller coaxial to the diffuser and-having an upstream and a downstream side. A rotatable shaft connects to the impeller, and when rotated the impeller is also rotated. Also included is an annular flow diverter or diffuser wear plate coaxially mounted on a downstream side of the impeller, which has vanes that project radially through the impeller. The impeller vanes are in fluid communication with the flow diverter through the passages. Further included is a fluid flow path extending through the vanes to an outer circumference of the impeller, into the diffuser directed radially toward an axis of the pump, and along an outer surface of the flow diverter.

In an alternative embodiment, disclosed is an electrical submersible pumping system that is made of a stack of impellers mounted on a rotatable shaft; where each impeller has an upstream side and a downstream side. Included is an annular flow diverter coaxially provided on the downstream side of each impeller. Vanes disposed in each impeller have an entrance on the upstream side. Diffusers circumscribe each impeller and flow diverter and define a stack of diffusers. Passages are provided that extend radially and axially in each diffuser and having a portion of which defined by an outer surface of the flow diverter circumscribed by the diffuser. A fluid flow path through the stack of impellers and stack of diffusers is defined by the passages and vanes.

DETAILED DESCRIPTION OF THE INVENTION

Figure 1A:
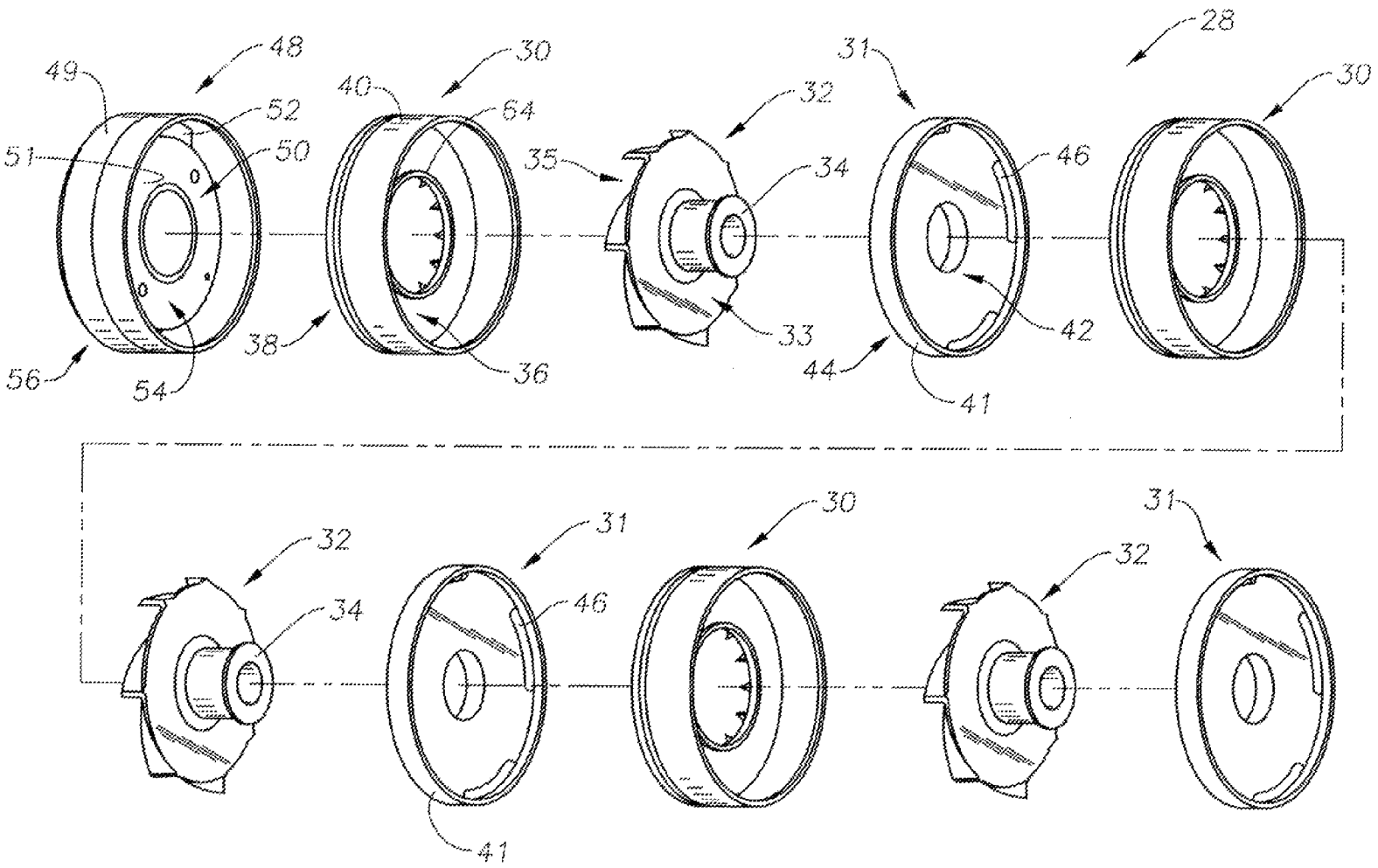
FIGS. 1A and 1B are exploded views of a stack of impellers and diffusers in accordance with the present disclosure.
Figure 1B:
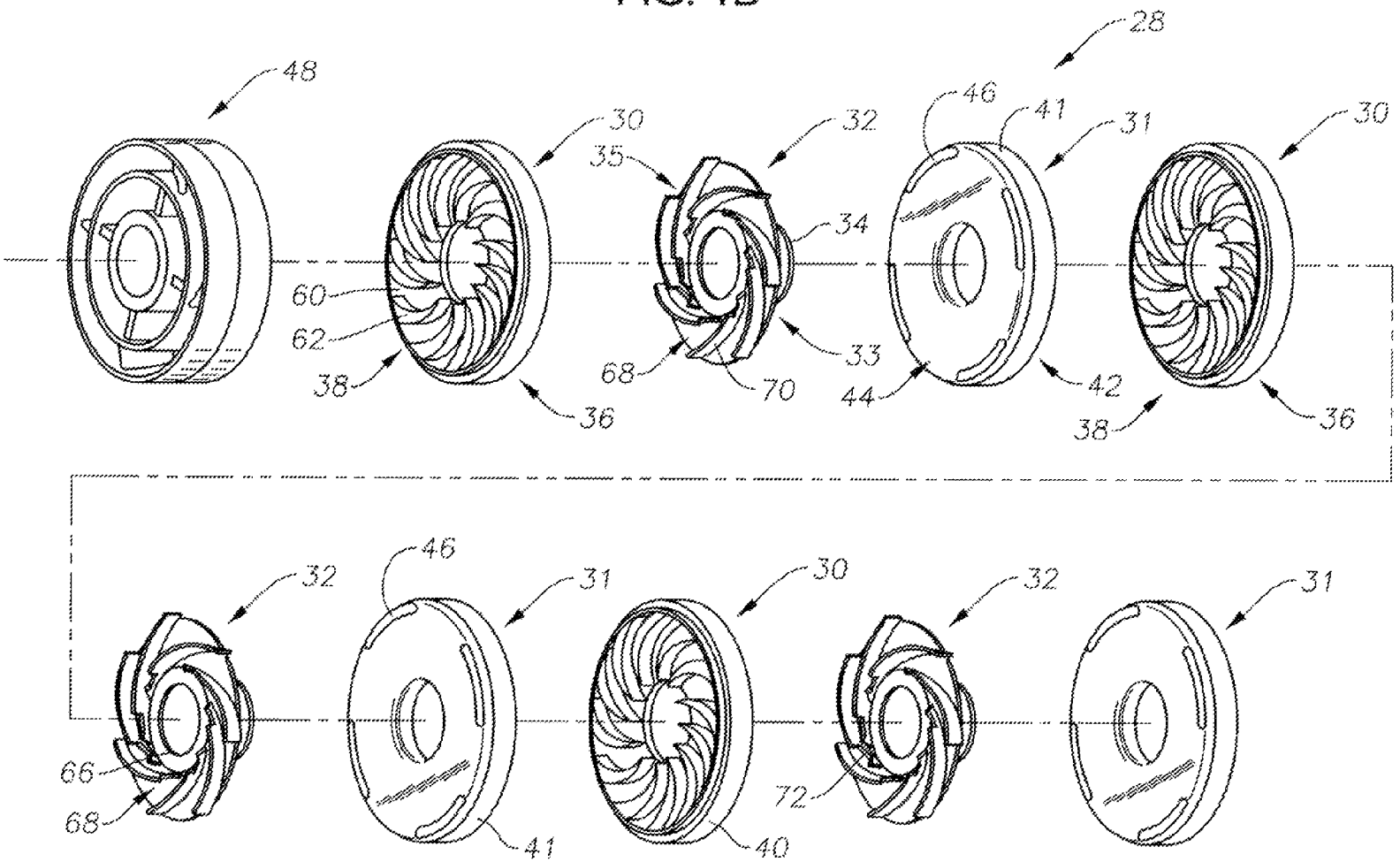
Figure 3:
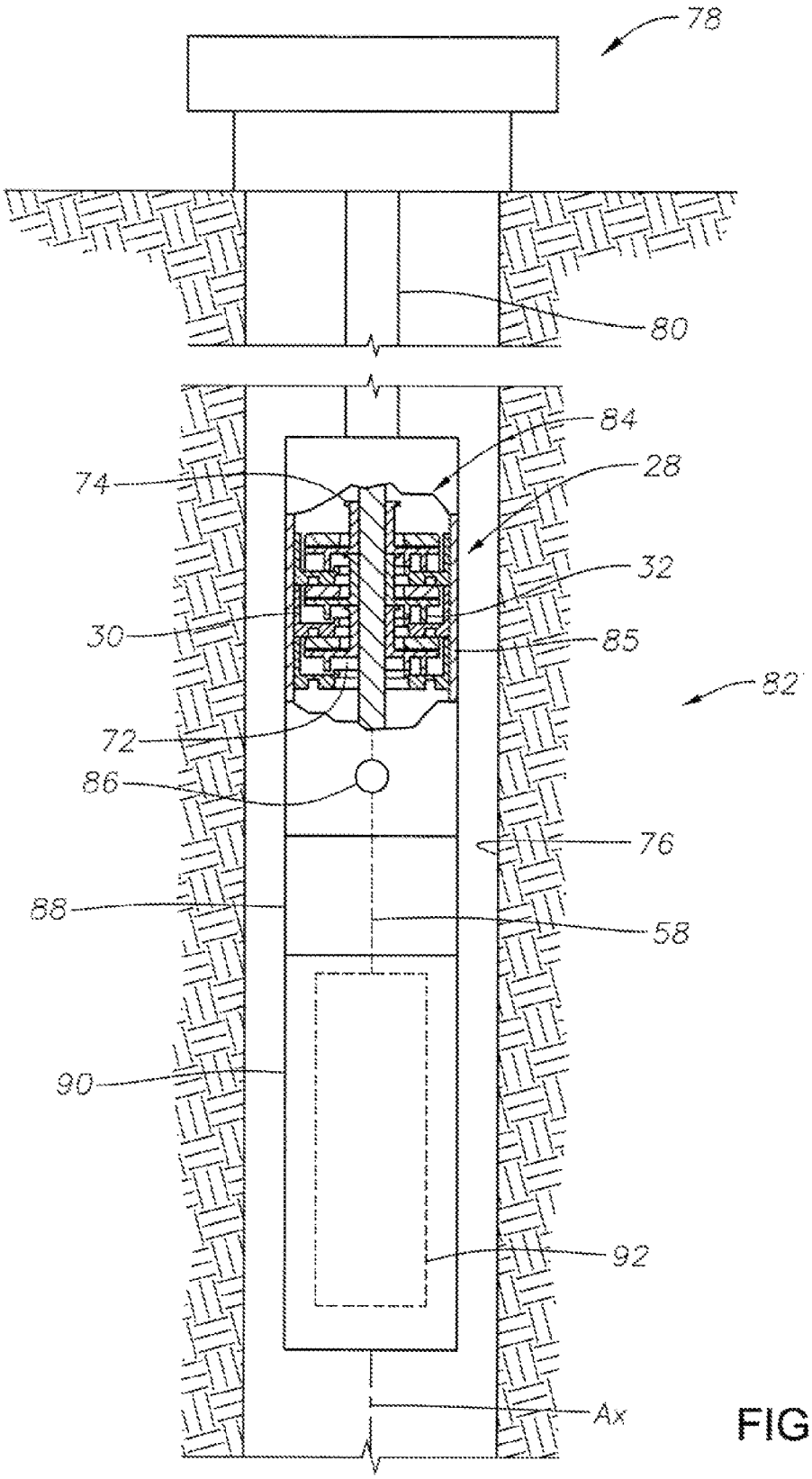
FIG. 3 is a side partial sectional view of an electrical submersible pumping system set in a wellbore.

Shown in an exploded view in FIGS. 1A and 1B are stacks 28 made up of diffusers 30, diffuser wear plates 31, and impellers 32. The diffusers 30, diffuser wear plates 31, and impellers 32 are each generally planar disk like elements that when coaxially assembled form generally cylindrical stacks 28 that are used in a pump for pumping fluids (FIG. 3). FIGS. 1A and 1B respectively provide perspective views of upper and lower surfaces of the diffusers 30, diffuser wear plates 31, and impellers 32. For the purposes of reference, each impeller 32 is depicted with a designated downstream side 33 shown facing an adjacent diffuser wear plate 31 and an upstream side 35 shown directed towards an adjacent diffuser 30. An annular bearing hub 34 is provided on the downstream side 33 of each impeller 32.

As described in more detail below, the bearing hub 34 defines a portion of a fluid flow path that winds through the stack 28. The bearing hub 34 may be hydro-isostatic press formed, welded or threadingly attached to the impeller 32; or optionally it may be integral with the impeller 32. An example of forming an impeller 32 with an integral bearing hub 34 can include a casting process or other manufacturing process as well as one that sinters powdered metal particles. Example metals used in manufacturing the impeller 32 and diffuser 30 include alloys of tungsten carbide, such as a tungsten carbide cobalt alloy. Optionally, the impeller 32 may be forged from metals such as aluminum, titanium, steel, alloys, combinations thereof, and the like. Alternately, base impeller, diffuser, and wear plate materials prior mentioned permits use of line-of sight hard coatings, hard facings, and/or other coatings harder than the base material that otherwise would not be permitted with previous designs.

Each diffuser 30 also includes a downstream side 36 and an upstream side 38. In the embodiment of FIGS. 1A and 1B, the downstream side 36 is facing the upstream side 35 of an adjacent impeller 32. Each diffuser 30 includes a cylindrical, coaxial outer sidewall 40 along its outer periphery that projects axially from the downstream side 36 and defines a space for receiving an adjacent and downstream impeller 32. As further illustrated in FIGS. 1A and 1B, the diffuser wear plate 31 also has a downstream side 42 shown facing an adjacent diffuser 30 and upstream side 44 opposite the downstream side 42 facing the downstream side 33 of an adjacent impeller 32. Wear plate 31 has a cylindrical, coaxial outer sidewall 41 that has a downstream edge in abutment with an upstream edge of diffuser sidewall 40. Wear plate sidewall 41 is stacked between and nonrotatable relative to the sidewalls 41 of diffusers 30 upstream and downstream from wear plate 31. Passages 46 are shown formed through the body of the wear plate 31 and along sections that are adjacent the outer periphery of the wear plate 31. A bearing carrier 48 is also illustrated in FIGS. 1A and 1B and on an upstream side 38 of one of the diffusers 30. The bearing carrier 48 of FIGS. 1A and 1B is made up of an outer tubular body 49 and annular midsection 50 mounted within the body 49. The bearing carrier 48 of FIGS. 1A and 1B further includes a sleeve-like bearing insert 51 coaxially mounted within the midsection 50. Passages 52 are formed axially through the bearing carrier 48 and between the midsection 52 and body 49.

Figure 2:
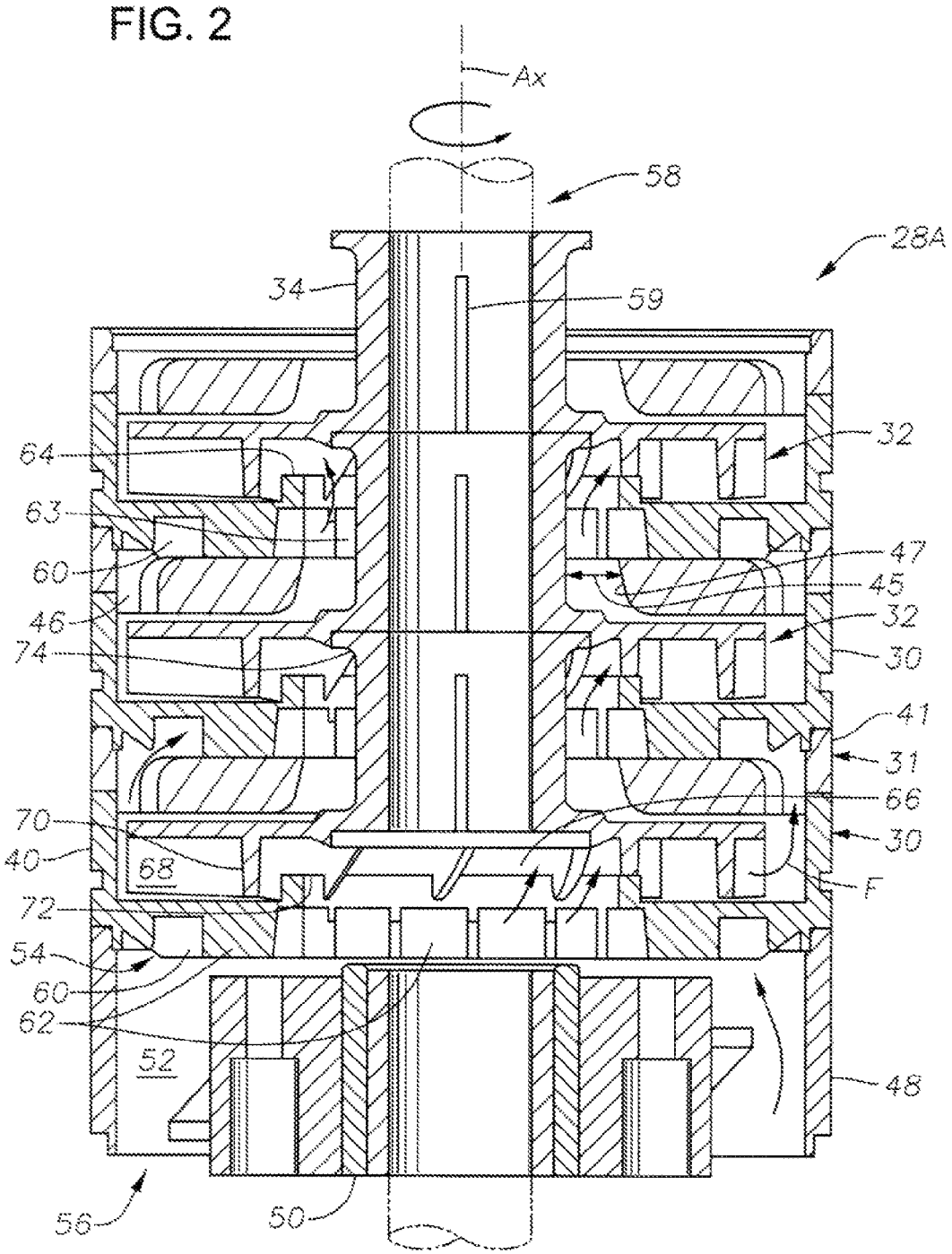
FIG. 2 is a side section view of a portion of submersible pump in accordance with the present disclosure.

Referring now to FIG. 2, the diffusers, impellers, and wear plates are shown coaxially combined end to end to form a stack 28A. For reference purposes, subscripts are included to identify the relative position of the diffusers, impellers, and wear plates in the stack with respect to the bearing carrier 48. With a plurality of stacks and bearing carriers throughout the pump and equally or not equally spaced bearing carriers providing radially stability to the impellers at intervals throughout the pump. More specifically, a diffuser $\mathbf{30}_i$ is shown coaxially mounted on the downstream side 54 of the bearing carrier 48. The upstream side 38 of the diffuser $\mathbf{30}_i$ is set facing the bearing carrier 48. Each of the bearing hubs 34 includes an axial bore so that when the impellers $\mathbf{32}_i$-$\mathbf{32}_2$ are stacked as shown in FIG. 2, an axial passage is formed therethrough and a drive shaft 58 is inserted therein. Axial keyways 59 shown along the inner surface of each bearing hub 34 are configured to receive a key (not shown) that also fits within the shaft 58 and thereby coupling the impellers with the shaft 58.

The stack 28A of FIG. 2 forms part of a pump; in an example of use, fluid flows through a winding passage in the stack 28A as illustrated by arrows F. In an embodiment, rotating the shaft 58 thereby rotates the impellers 32 that then draws fluid from below the bearing carrier 48, into the passage 52, from the upstream side 56. The fluid exits the passage 52 at the downstream side 54 of the bearing carrier 48 and enters diffuser flow passages 60. The flow passages 60 follow a curved path from the outer diameter towards a midsection of the diffuser 38. The flow passages 60 are formed by diffuser vanes 62 shown provided on the upstream side 38 of the diffusers 30 and arranged along a circular pattern on the outer portion of the upstream side 38. In the embodiment of FIG. 2, the fluid enters the passages 60 proximate the outer periphery of the diffusers 30 and is directed radially inwards toward the axis $A_X$ of the stack 28A. The flow is directed axially through the diffusers 30 within a bore 63 formed along the diffuser axis.

An annular shroud 64 circumscribes the diffuser bore 63 and serves to direct the flow from the upstream side 38 of the diffusers into an impeller throat 66 that is coaxially around the axis AX and within the impeller 32. Impeller flow passages 68 are depicted on the upstream side 34 of the impeller 32 that are generally curved and have an increasing width with proximity to the outer periphery of the impeller 32 (FIG. 1B). A series of curved impeller blades 70 are set on the upstream side 35 of the impeller 32. The passages 68 are defined in the spaces between adjacent impeller blades 70. Proximate the axis of each impeller 32 a notch 72 is formed within each impeller blade 70 so that the shroud 64 of the adjacent upstream diffuser may partially project into the impeller 70. Thus, as the shaft 58 rotates the fluid enters into the impeller flow passages 68 proximate to the axis AX and is directed radially outward.

In the example embodiment of FIG. 2, the dimensions of the sidewall 40 of the diffuser exceed the height of the impeller blades 70. When the fluid exits the impeller flow passages 68, the fluid contacts an inner surface of the sidewall 40 where it is then directed upward and towards a wear plate 31. The wear plate 31 is shown set on a downstream side 33 of the impeller 32. As noted above, each wear plate 31 includes passages 46 formed along the outer periphery of the wear plate 31. An annular gap 45 is defined between an inner diameter 47 of wear plate 31 and impeller hub 34. The fluid exiting each of the impeller flow passages 68 of FIG. 2, enters the passages 46 and is directed into diffuser flow passages 60 of a downstream diffuser. In the example of FIG. 2, the diffuser downstream of the wear plate 31*i*is designated as 30*i*+1 . After entering the flow passages 60 of diffuser 30*i*+1 , the fluid is directed radially inward toward the axis and into contact with an outer surface of the bearing hub 34 mounted on the downstream side 33 of impeller 32*i*. Fluid flows substantially axially along the outer surface of the bearing hub 34 and encounters a lip 74 on an end of the bearing hub 34 opposite where it attaches to the impeller 32*i*. Wear plate inner diameter 47 is greater than the outer diameter of lip 74. The lip 74 has an outer surface profiled to extend radially outward so that as the fluid flows past the bearing hub 34, the fluid is directed radially outward. Thus, the fluid is flowing in a direction substantially aligned with impeller passages 68 provided within impeller 32*i*+1 . The above-described flow path is repeated along the length of the stack 28A and with increasing pressure along the length of the stack 28A.

Shown in a side partial sectional view in FIG. 3 is a wellbore 76 capped with a wellhead 78 and production tubing 80 depending from the wellhead 78 into the wellbore 76. An electrical submersible pumping system (ESP) 82 is shown attached on a lower end of the production tubing 80. In the example embodiment of FIG. 3, the ESP 82 includes a pump section 84 for pumping fluids from the wellbore 76 into the production tubing 80 and to the wellhead 78. Fluid (not shown) in the wellbore 76 flows into the pump section 84 through an inlet 86 shown formed on an outer surface of the pump section 84. On a lower end of the pump section 84 is a seal section 88 for equalizing pressure within the ESP 82 to ambient conditions. A motor section 90 is shown on a lower end of the seal section 88 that includes a motor 92 (shown in phantom) coupled to an output shaft 58 (also shown in phantom). The output shaft 58 extends axially through the seal section 88 of the ESP 82 and into the pump section 84. Shown within a housing 85 of the pump section 84 is an example embodiment of the stack 28 of FIGS. 1A, 1B, and 2. The output shaft 58 rotates when the motor 92 is energized to rotate the impellers 32 within the pump section 84 and pump fluid from the wellbore 76 into the production tubing 80 for delivery to the wellhead 78.

The invention has significant advantages. It is to be understood that the invention is not limited to the exact details of the construction, operation, exact materials or embodiment shown and described, as obvious modifications and equivalents will be apparent to one skilled in the art.

I claim:

1. An electrical submersible pump assembly having an axis and comprising:

a centrifugal pump;

an electrical motor coupled to the pump for driving the pump; the centrifugal pump comprising:

an annular diffuser having an annular diffuser outer sidewall;

diffuser vanes that extend axially and radially within the diffuser from a central bore of the diffuser, defining diffuser passages;

an impeller coaxial to the diffuser and having an upstream and a downstream side;

a rotatable shaft connected to the impeller for rotating the impeller;

an annular wear plate coaxially mounted on a downstream side of the impeller, the wear plate having a wear plate outer sidewall that has a downstream edge in non rotating abutment with an upstream edge of the diffuser outer sidewall, the wear plate having a downstream side surface and an upstream side surface circumscribed by the wear plate outer sidewall, and at least one wear plate passage extending from the upstream side surface to the downstream side surface of the wear plate adjacent to the wear plate outer sidewall;

impeller vanes projecting radially through the impeller that are in fluid communication with the wear plate passage; and a fluid flow path extending through the impeller vanes to an outer circumference of the impeller, through the wear plate passage and into the diffuser passages, and through the diffuser passages to the central bore of the diffuser.

2. The pump assembly of claim 1, wherein the wear plate outer sidewall is cylindrical, and the upstream side surface and the downstream side surface of the wear plate are flat and parallel with each other.

3. The pump assembly of claim 1, wherein the at least one wear plate passage comprises a plurality of the wear plate passages spaced circumferentially apart from each other around the wear plate.

4. The pump assembly of claim 1, wherein the diffuser passages in the diffuser each have an inlet on an upstream side of the diffuser and an outlet at the central bore.

5. The pump assembly of claim 1, further comprising:

an impeller hub set in an annular space between the impeller and the shaft and coupled to the impeller and the shaft, the impeller hub extending in a downstream direction from the impeller through an inner diameter of the wear plate and the central bore of the diffuser.

6. The assembly pump of claim 1, wherein the impeller comprises a first impeller, the diffuser comprises a first diffuser, and the wear plate comprises a first wear plate, the pump further comprising a second impeller coaxially mounted on the shaft on a downstream side of the first impeller, a second wear plate coaxially mounted on a downstream side of the second impeller, and a second diffuser mounted on the downstream side surface of the second wear plate.

7. The pump assembly of claim 1, wherein the diffuser passages have open upstream sides, and the downstream side surface of the wear plate abuts and closes the open upstream sides of the diffuser passages.

8. The pump assembly of claim 1, further comprising:

an impeller hub in an annular space between the impeller and the shaft and coupled to the impeller and the shaft; and an annular gap between the impeller hub and an inner diameter of the wear plate.

9. The pump assembly of claim 1, wherein the impeller vanes are open in the upstream direction.

10. An electrical submersible pumping system comprising:

a submersible pump having a longitudinal axis;

an electrical motor coupled with the pump for driving the pump; the pump comprising:

a stack of impellers mounted on a rotatable shaft, each impeller having an upstream side and a downstream side and a plurality of impeller vanes extending outward relative to the axis, defining impeller passages;

an annular wear plate coaxially provided on the downstream side of each impeller, each of the wear plates having a wear plate outer sidewall that is cylindrical and coaxial, a wear plate body extending inward from the wear plate outer sidewall to a wear plate inner diameter, the wear plate body of each of the wear plates having at least one wear plate passage adjacent to the wear plate outer sidewall and extending from an upstream side to a downstream side of the wear plate body;

diffusers circumscribing each impeller and having diffuser outer sidewalls that are cylindrical and coaxial to define a stack of diffusers;

each of the wear plate sidewalls being sandwiched between two of the diffuser sidewalls and non rotatable relative to the diffuser sidewalls;

diffuser passages that extend radially and axially in each diffuser, each of the diffuser passages having an open upstream side abutted by the downstream side of the wear plate body of one of the wear plates; and a fluid flow path through the stack of impellers, the wear plates, and the stack of diffusers defined by the diffuser passages, the vane passages and wear plate passages.

11. The electrical submersible pumping system of claim 10, wherein each of the impellers has a hub with a downstream lip, and wherein the inner diameter of the wear plate is larger than an outer diameter of the lip.

12. The electrical submersible pumping system of claim 10, wherein the the downstream side of the wear plate body of each of the wear plates is flat and in a plane perpendicular to the axis.

13. The electrical submersible pumping system of claim 10, wherein the upstream side of the wear plate body of each of the wear plates is flat, in a plane perpendicular to the axis, and spaced axially from a next upstream one of the impellers.

14. The electrical submersible pumping system of claim 10, further comprising an impeller hub set in an annular space between each of the impellers and the shaft and coupled to one of the impellers and the shaft, the impeller hub extending through the wear plate inner diameter of a next downstream one of the wear plates.

15. The electrical submersible pumping system of claim 10, wherein the at least one wear plate passage comprises a plurality of wear plate passages spaced circumferentially apart from each other.

16. The electrical submersible pumping system of claim 10, wherein the diffuser passages of each of the diffusers are defined by diffuser vanes that have upstream edges in abutment with the downstream side of the wear plate body of a next upstream one of the wear plates.

17. The electrical submersible pumping system of claim 10, further comprising:

an impeller hub set in an annular space between each of the impellers and the shaft and coupled to one of the impellers and the shaft, the impeller hub extending through the wear plate inner diameter of a next downstream one of the wear plates; and an annular gap between the impeller hub and the wear plate inner diameter of the next downstream wear plate.

18. The pump of claim 5, wherein the impeller vanes of each of the impellers is open in an upstream direction and spaced axially from a next upstream one of the diffusers.

19. The electrical submersible pumping system of claim 10, further comprising:

an impeller hub set in an annular space between each of the impellers and the shaft and coupled to one of the impellers and the shaft, the impeller hub having a downstream lip and extending through the wear plate inner diameter of a next downstream one of the wear plates; and wherein the inner diameter of the next downstream wear plates being greater than an outer diameter of the hub.

20. An electrical submersible pumping system, comprising:

a centrifugal pump having a housing, a shaft extending along a longitudinal axis, and a plurality of stages, each of the stages comprising:

an impeller having a plurality of vanes defining impeller passages, the impeller having a hub mounted to the shaft for rotation therewith;

a diffuser downstream from the impeller, the diffuser having a coaxial, cylindrical sidewall in non rotating engagement with an inner surface of the housing, the diffuser having a central bore and a plurality of diffuser vanes extending outward from the central bore, defining diffuser passages, each of the diffuser passages having an open upstream side;

a wear plate located between the impeller and the diffuser, the wear plate having a coaxial cylindrical sidewall non rotatably stacked on the cylindrical sidewall of the diffuser, the wear plate having a flat wear plate body extending inward from the sidewall of the wear plate to an inner diameter of the wear plate, the inner diameter of the wear plate being spaced radially outward from the hub, the wear plate body having a downstream side in abutment with the diffuser vanes, thereby closing the open upstream sides of the diffuser passages;

a plurality of wear plate passages formed through the wear plate body adjacent to the sidewall of the wear plate, the wear plate passages being circumferentially spaced apart from each other, wherein each of the stages defines a fluid flow path leading from outer ends of the impeller passages through the wear plate passages into outer ends of the diffuser passages, and through the diffuser passages to the central bore; and a motor operatively engaged with the shaft of the pump for rotating the impellers.

* * * * *

UNITED STATES PATENT AND TRADEMARK OFFICE

CERTIFICATE OF CORRECTION

PATENT NO. : 8,747,063 B2
APPLICATION NO. : 12/877769
DATED : June 10, 2014
INVENTOR(S) : Kevin Scott Tingler It is certified that error appears in the above-identified patent and that said Letters Patent is hereby corrected as shown below:

In the Specification
Column 2, line 2, after "which" insert --is--
Column 3, line 26, delete "58 and" and insert --58,--

In the Claims
Column 6, line 66, after "downstream" insert --one of the--

Signed and Sealed this
Thirtieth Day of December, 2014

Michelle K. Lee

Michelle K. Lee
*Deputy Director of the United States Patent and Trademark Office*